US005499419A

United States Patent [19]

Baranowski

[11] Patent Number: 5,499,419

[45] Date of Patent: Mar. 19, 1996

[54] FACILITATOR FOR ASSISTING WHEELCHAIR CHALLENGED PERSONS UP AND/OR DOWN INCLINES TRAVERSED BY A PATHWAY ACCESS SYSTEM

[76] Inventor: Edwin M. Baranowski, 75 Marrus Dr., Gahanna, Ohio 43230

[21] Appl. No.: 379,183

[22] Filed: Jan. 27, 1995

Related U.S. Application Data

[63] Continuation-in-part of Ser. No. 86,252, Jul. 1, 1993, Pat. No. 5,402,546, which is a continuation-in-part of Ser. No. 826,838, Jan. 27, 1992, Pat. No. 5,319,818.

[51] Int. Cl.[6] ..... E01D 15/00

[52] U.S. Cl. ..... 14/69.5; 14/71.1; 414/921

[58] Field of Search ..... 14/69.5, 71.1, 14/71.3, 72.5, 71.5; 280/5.2, 5.24, 250.1; 180/8.2; 52/179, 180, 181, 182; 414/921, 537, 538

[56] References Cited

U.S. PATENT DOCUMENTS 4,528,711 7/1985 Packer ..... 14/69.5

*Primary Examiner*—Ramon S. Britts
*Assistant Examiner*—Pamela A. O'Connor

[57] ABSTRACT

An improvement in apparatus for assisting the transit of a person seated in a chair transport device in either direction between a lower level and an upper level in which a longitudinally extended pathway having upper and lower ends is disposed between the lower level and the upper level to accommodate a support on a side of a chair and in which the pathway includes at least one stop for maintaining the location of the chair at a predetermined location along the length of the pathway, the stop being at a location along the length of the pathway intermediate the upper and lower ends thereof.

21 Claims, 2 Drawing Sheets

FIG. 1
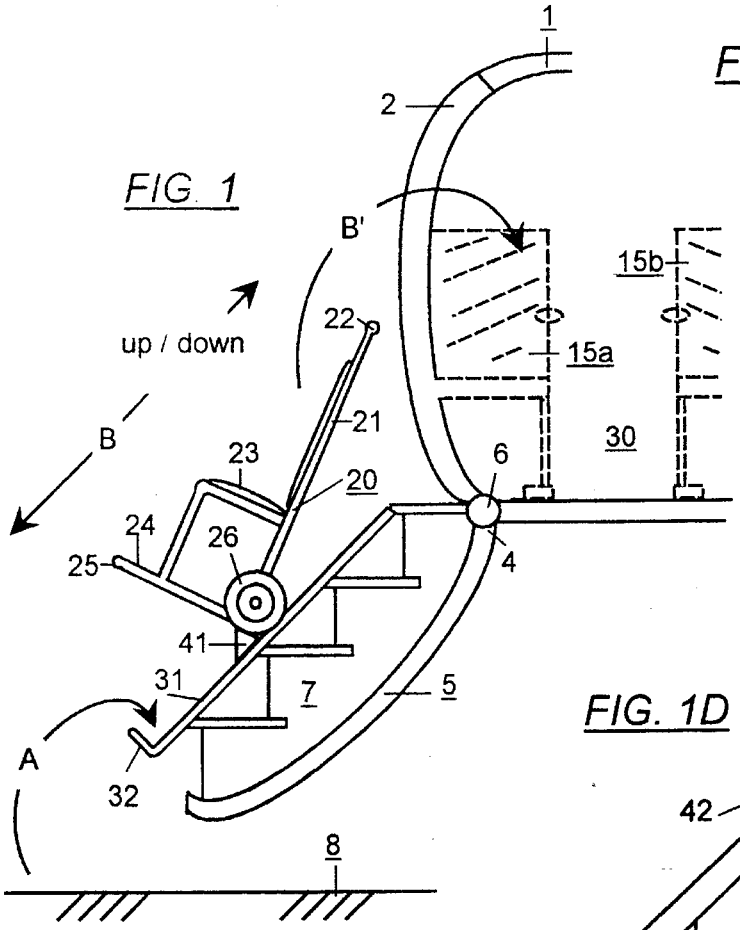
FIG. 1B
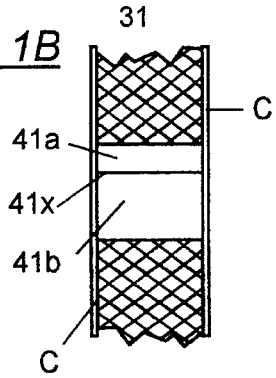
FIG. 1D
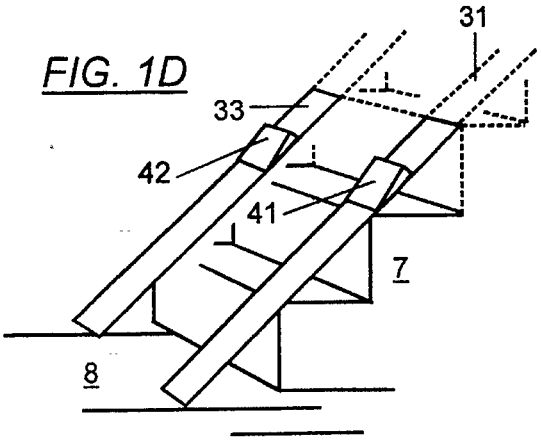
FIG. 1C
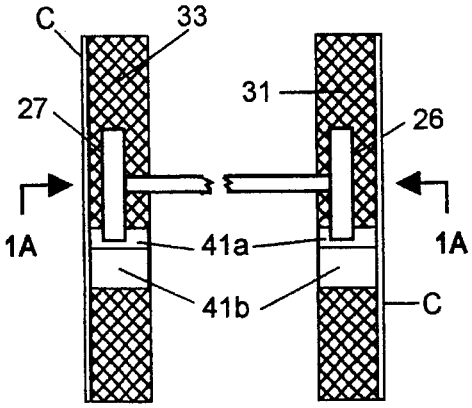
FIG. 1A
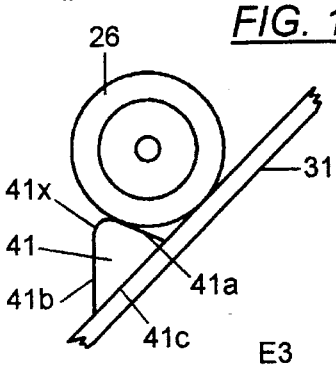
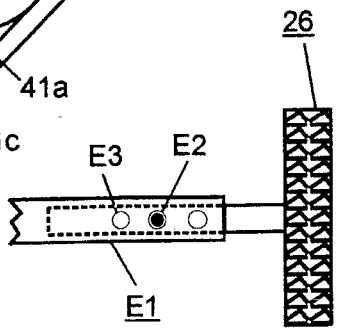
FIG. 1E

FACILITATOR FOR ASSISTING WHEELCHAIR CHALLENGED PERSONS UP AND/OR DOWN INCLINES TRAVERSED BY A PATHWAY ACCESS SYSTEM

RELATED APPLICATIONS

This is a continuation-in-part of my application Serial No. 08/086,252 filed on Jul. 1, 1993, now U.S. Pat. No. 5,402,546, which was a continuation-in-part of my application Ser. No. 07/826,838 filed on Jan. 27, 1992, now U. S. Pat. No. 5,319,818, the content of both of which is incorporated herein by reference.

FIELD OF THE INVENTION

This invention relates to a facilitator for assisting wheelchair challenged persons over stairways adapted to wheelchair assistance mechanisms having sloped access pathway devices. The facilitator is useful where narrow stairways having a steep slope, such as are encountered in aircraft cabin stairs, are found. In aircraft applications, the invention is an improvement of the system of my referenced U.S. Pat. No. 5,402,546, and makes easier the effort required by assistants in transporting chair assisted passengers to and from the cabin of a small aircraft as the passenger embarks or disembarks when access pathways extending over the cabin stairs are used. In certain circumstances that are an exception to conventional design practices for stairways, namely, where a stairway is steeply sloped, the invention may also find use in non-aircraft pathway applications, up and down steeply inclined stairways with multiple steps, particularly where the slope to be traversed is greater than about an approximately 45° slope with respect to horizontal.

BACKGROUND OF THE INVENTION

In the prior art relating to aircraft, a person requiring wheelchair assistance for airplane travel is, most of the time, first seated in a device known as a "straightback," an "aisle chair," a "gurney" or other moniker, and, while in the chair, is carried/directed to an assigned seat in the aircraft cabin. A chair of such type is shown in side view in FIG. 1 at reference numeral 20. The chair is narrow, having a seat protruding from a straight back, and a foot prop at the bottom; the width of the chair is less than that of the aircraft aisle 30 in FIG. 1. Typically two wheels are at the back of the chair (one on each side) as illustrated; some chairs include four wheels (one at each of the front and back corner of each side of the chair). The wheels may be inside, outside, or aligned flush with the chair side frame. For access to the cabin area of a small aircraft, the passenger is strapped in the chair, and physically carried up the gangway stairs and seated in the aircraft. Two personnel do the work. In this environment, the passenger is transferred from her/his "ordinary" chair into the special purpose aisle chair.

OBJECTS AND SUMMARY OF THE INVENTION

An object of the invention is to reduce the effort and enhance the security of the transit process in which the assistants transport a person in a chair up or down a sloped pathway by providing a rest and orientation stop intermediate the length of the pathway. In addition to aircraft uses, the invention may find use in swimming pool applications where a special purpose chair, as opposed to the swimmer's "ordinary" chair is used to enter and exit the pool. The invention is understood more readily by reference to the following description of the preferred embodiment, taken in conjunction with the drawings in which:

BRIEF DESCRIPTION OF THE DRAWINGS

FIG. 1 is a side view through a cross section of an aircraft having an open hatchway and cabin stairs with access pathways deployed thereon, utilizing the invention and supporting a typical type of straightback chair.

FIG. 1A is a side detail view of a section of the access pathway showing the relationship of the pathway, straightback wheel, and a rest/orientation stop intermediate the pathway.

FIG. 1B is a top view of a section of the access pathway showing the rest/orientation stop.

FIG. 1C is a top plan view of the access pathway showing the rest/orientation stop and the wheels of the straightback aligned thereon.

FIG. 1D shows an application in which the sloped pathways extend directly from and to an upper level and a lower level.

FIG. 1E shows an adjustable length axle having a telescoping arrangement of a rod and cylinder and a springed pin to fix the wheel separation to the presenting separation distance of the pathways.

Figure 4:
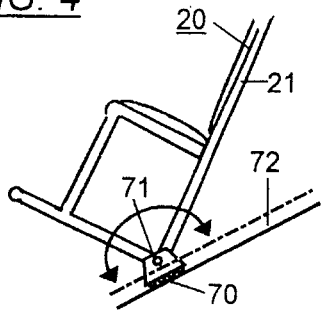
FIG. 4 shows an alternative chair that includes a sliding support.
Figure 5:
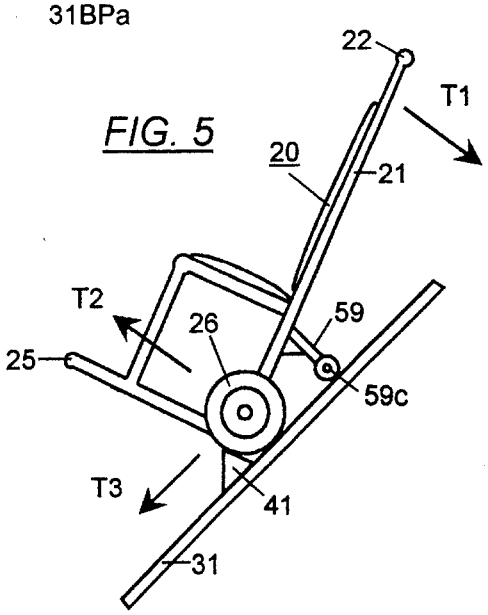
FIG. 5 shows a tilt system useful in overcoming the stop in downward movement of the chair over the stop.

(For clarity in FIG. 1, FIG. 4 and FIG. 5 where a chair is shown but the passenger is not, and in other references herein, a person is assumed to be seated in the chair.)

DESCRIPTION OF THE PREFERRED EMBODIMENT

The example depicted in FIG. 1 shows a cross section at the cabin hatchway 2 of a small commuter passenger aircraft 1. The bottom end edge 4 of the door 5 is hinged to a support 6 at the side of the aircraft. When in the open position as shown in FIG. 1, the door hangs downwardly from the aircraft body, and in this position, forms a stairway 7 leading from the ground 8 into the aircraft. The distance from the bottom stair to the ground is about a foot (approximately 12 inches or 30 centimeters). Typically rails, a cable, or other support extending the length of the stairway, and vertical supports, as discussed in U.S. Pat. No. 5,402,546,are included at the stairs. The stairway is usually narrow (approximately about 24 inches or 60 centimeters) and retracts into the interior of the aircraft when the door is closed.

The chair is illustrated in side view at 20, having a frame with back 21, upper handle 22, seat 23, foot support 24, with lower handle 25 and side wheel 26 resting on pathway 31 as shown in FIG. 1. Both side wheels 26 and 27 and both pathways 31 and 33 are illustrated in FIGS. 1C, 3A and 3B. (Chairs in use are about approximately 50 to 60 inches high (a scale of about 1.3 meters) and about approximately 12 to 16 inches (30 to 40 centimeters) wide. In the normal course, the passenger is seated in the chair, safety straps secure the person on the chair, and two personnel, one at the upper handle 22, and the other at the lower handle 25 lift and guide the person and chair up or down the stairway. It is evident that, without the use of an intermediary device, such as the pathway systems of my aforementioned patents, it may be necessary for the assistant at the upper handle 22 to do considerable downward bending as the assistant backs up the stairs. Likewise, the front assistant at 25 may assume some physiologically uncomfortable position. The overall weight distribution between front and back, affecting strength and effort needed, may also be indeterminate between the two assistants at the upper and lower handles. When the pathway system is used, an inclined plane is provided for the chair and conventional access to the stairs by the able bodied assistants is preserved.

My U.S. Pat. No. 5,402,546 shows a configuration in which the ends of each pathway include a "stop" 32. Once the chair is lifted up as shown in FIG. 1, and disposed on the pathways (as shown by step "A" depicted in FIG. 1, representing a first lift), the assistants, after (1) the initial exertion of effort represented by lift A, can rest, regroup, or reorient themselves for (2) the second stage of the push, pull and roll upward, represented by arrows "B" and "B'" in FIG. 1, taking the passenger to the upper level, for example, into the aircraft cabin, in which the person is guided to the aircraft seat 15*a*, 15*b*, or other seat to which the passenger is assigned or desires. Guiding the person downward is the reverse process.

In the invention, an intermediate stopping, resting, or orientation location is provided along the pathway as illustrated in FIG. 1 at 41. The stop essentially provides a brake, stopping the movement of the chair at a predetermined point. Depending on the length of the stairway and/or the steepness of the slope, more than one stop may be desirable. Intuitively, a stop at every second or third stair, when two people guide the chair is a preferred relationship. However, to the extent that a steeply sloped stairway is very extended (e,g., 6 feet or 2 meters) the limit of utility of a pathway system for the transport of a person in ordinary, every day activities with respect to such a steeply extended slope may be reached and alternative transport devices may become more preferred.

Thus, a stairway access device for providing assistance in the transit of a stairway to persons seated in a chair transport device is provided that reduces the effort and enhances the ease and comfort in which chair bound persons are transported, or guided up steep inclines over pathways extending between upper and lower and lower and upper levels. The pathways include at least one rest stop for maintaining the location of the chair at a predetermined location along the length of the pathways, the stop being at a location along the length of the pathways intermediate the upper and lower ends thereof so that the assistants directing the chair are allowed an opportunity for rest and orientation as they guide the chair up or down the stairway.

With reference to FIG. 1, FIG. 1A, FIG. 1B, FIG. 1C, and FIG. 1D, a stop comprising an essentially triangular shape in its longitudinal cross-section, preferably having a smooth upper apex, is shown at 41 on the pathway 31 in FIG. 1, FIG. 1A and FIG. 1B and FIG. 5 and at 41 and 42 in FIG. 1C and FIG. 1D. Curb sections at the side edges of the pathways are shown by reference letter C. In this embodiment, the side support of the chair 21 that includes wheel 26 rests at triangle side 41*a* and may roll along triangle side 41*b*. Triangle side 41*c* is secured to or formed intrinsically in the pathway 31. The apex of the triangle 41*x* is a smooth curve that prevents damage to the chair side wheel(s) (that usually include a tire) and facilitates movement over the "bump" in the pathway caused by the stop means.

As referenced above, my prior patent describes a pathway system for aircraft cabin stairs in which, referring to FIG. 1, the aisle chair is lifted from the ground level 8 to the lower end of the pathways, arrow A, where a first stop comprising an upwardly extending extension of the lower end of the pathway 32 is included as a first stop. When a second stop, such as 41 is included in an intermediate section of the pathway, here disposed essentially at the midpoint section of the pathway, an additional opportunity for rest and orientation (following a first exertion of effort) is provided for completing the transit of the chair up the stairway and to the upper level, in the instance of an aircraft, into the passenger cabin, shown by arrows B and B' in FIG. 1. In FIG. 1E an adjustable length axle for the wheels is shown in which the axle E1 is a telescoping arrangement of a cylinder and rod. A springed pin E2 in a corresponding spaced hole, such as E3. . . fixes the wheel separation to the separation distance of the pathways to adapt to a fixed separation pathway installation.

Figure 2:
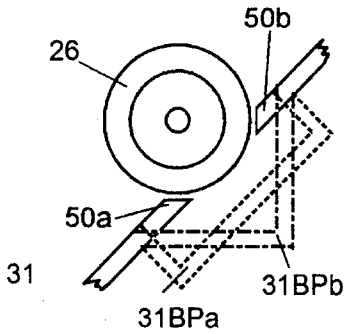
FIG. 2 is a side view of alternative stop configurations formed in the pathway.
Figure 2A:
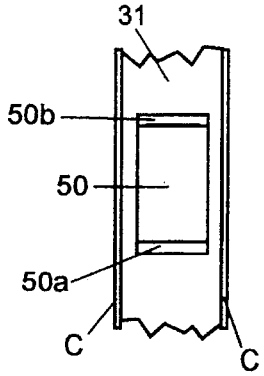
FIG. 2A is a top view of a section of an access pathway including intermediate stops, such as shown in FIG. 2.

In an alternative embodiment shown in FIG. 2 and FIG. 2A, the stop comprises an opening 50 within the length of each pathway, 31 being shown, adapted to receive therein a segment of a support, such as the wheel 26 shown, on a side of the chair. Preferably, the opening has smooth internal sides, such as the beveled angles shown at 50*a* and 50*b* in the cross-section depicted in FIG. 2 and the top view of FIG. 2A, at the upper and lower ends of the opening, again to prevent damage to the tires of the chair, and to facilitate entry into and exit from the opening as a stop point. Preferably, the length of the opening extends a length within the pathway less than the diameter, or 180° arc, of the wheel. (If greater than a diameter, the wheel would fall through the opening, unless a back plate support such as shown in FIG. 2 at 31BPa or 31BPb by dashed lines, were provided to form a recessed cavity to receive the wheel in the pathway.) In FIG. 2 the opening corresponds approximately to a 45° arc segment of the wheel.

Figure 3:
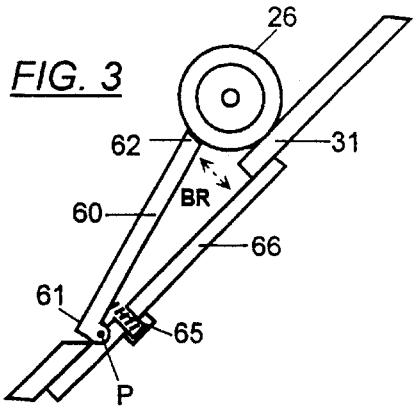
FIG. 3 is a side view of a spring loaded brake or stop mechanism.
Figure 3A:
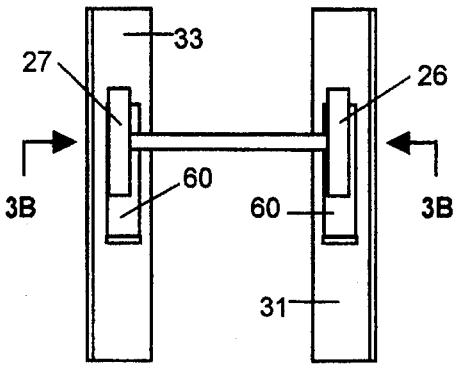
FIG. 3A is a top plan view of the pathway of FIG. 3 showing the straightback chair wheels thereon.
Figure 3B:
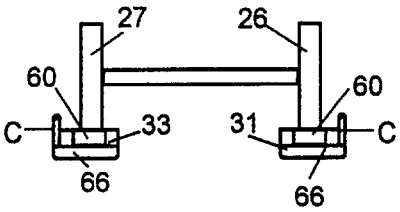
FIG. 3B shows the relationship of straightback chair wheels to the stop of FIG. 3 when the stop is depressed within the pathway.

A pivot system is shown in FIG. 3, FIG. 3A and FIG. 3B. In these figures a pivoted retractable brake 60 is pivotally disposed from its lower end section 61 at pivot point P along the length of the pathway 31. The brake may also be pivoted at an intermediate section or at the upper end section thereof 62 and may include a straight or "L" end shape to provide the stop in operative relation to a support or wheel on the chair side.

Figure 3C:
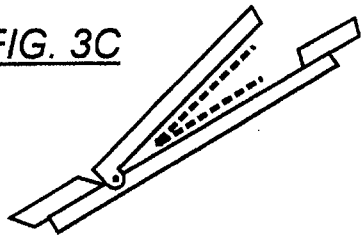
FIG. 3C and FIG. 3D show spring variations useful with a pathway of FIG. 3.
Figure 3D:
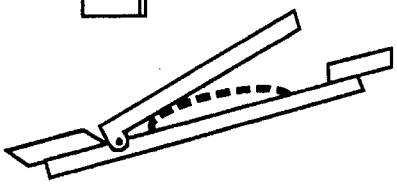

The pivot alternative provides a retractable stop and may include a spring, for example, coil spring 65, in operative combination with the pivot to maintain the brake in a position such that the brake stops the movement of the chair on the pathway as is shown in FIG. 3. As the chair passes along the pathway 31, the weight of the chair will keep the brake 60 depressed at the upper surface of the pathway against back plate 66. When the chair passes the upper end segment of the brake 62, the force of the spring will eject the brake to provide the stop for the wheel as shown in FIG. 3. In downward movement, the brake is already in an "up"

position that stops the movement of the chair; the chair is moved over the top of the brake and the brake becomes depressed for passage. The position of the brake moves with respect to upper and lower positions as indicated by arrow BR in FIG. 3. FIG. 3C and FIG. 3D show alternative shapes of springs, in addition to the coil spring shown at 65 in FIG. 3, that may be adapted for use with the pivot alternative. In downward movement of the chair, a manual lever system may be used to depress the brake. The chair itself may be adapted to traverse the stop in the pathway, whatever form that stop may have.

FIG. 5 shows a tilt system operating on a lever principle in which, as the back of the chair is tilted back, movement arrow T1, the tilt mechanism affixed to the chair back 59 allows the wheel(s) of the chair 26 to be lifted above the pathway 31, shown by movement arrow T2, to traverse the stop 41 (or brake) so that the chair may continue in its downward passage, shown by movement arrow T3. The tilt may include a caster or like device, facilitating movement on the pathway, as is shown at 59*c*. The leveraged tilt mechanism can be suitably adapted to other forms of stops used in the pathways.

While a wheeled support is referred to for reference purposes herein, there are other mechanisms that permit movement of an object along a linear surface, such as casters, rollers, slides, fixed rails and tracks and their co-operative moving elements, opposed flat surfaces and the like. Similarly, a side of the chair can likewise be pivoted to allow movement corresponding to a wheeled side, such as shown in FIG. 4 in which the chair 20 includes a slide 70, pivoted with respect to chair back 21 at point 71 on the sloped pathway 72. Such alternatives may find use in certain applications for the device, for example, as a pool entrance and exit system.

As shown respectively in FIG. 1 and FIG. 1D, the lower ends of the pathways may be elevated above ground level (FIG. 1) or may extend from the ground level (FIG. 1D). As related in my U.S. Pat. No. 5,402,546, aircraft cabin stairs with which the invention is useful may be formed in and/or disposable from the aircraft hatchway door, or may comprise a portable stairway apparatus that is wheeled to an open hatchway door.

What is claimed is:

1. Apparatus for assisting transit of a person seated in a chair transport device in either direction between a lower level and an upper level including:

a pair of separate spaced-apart longitudinally extended pathways having upper and lower ends disposed between the lower level and the upper level, each pathway having a width sufficient to accommodate a support on one side of a chair, in which the separation of the pathways is sufficient to provide an access path for at least one assistant who guides the chair with respect to the pathways, and in which each pathway includes at least one stop for maintaining the location of the chair at a predetermined location along the length of the pathways, the stop being at a location along the length of the pathways intermediate and spaced from the upper and lower ends thereof.

2. The apparatus of claim 1 in which the lower ends of the supports on each side of the chair include one of a sliding mechanism and a rolling mechanism.

3. The apparatus of claim 1 in which at least one of the pathways includes an upwardly extending curb section longitudinally included on at least one side edge thereof.

4. The apparatus of claim 1 in which the pathways are disposed such that the lower end of the pathway is elevated above the lower level and each pathway includes a first stop comprising an upwardly extending extension of the lower end.

5. The apparatus of claim 1 in which the stop comprises a shape that in its longitudinal cross-section is essentially triangular and protrudes above the extended pathways.

6. The apparatus of claim 1 in which the stop comprises an opening within the length of each pathway, the opening adapted to receive temporarily therein the lower end of a support on a side of the chair.

7. The apparatus of claim 6 in which the lower ends of the supports on each side of the chair include a wheel and in which the opening in the pathways is sufficiently wide to receive a segment of the wheel and extends a length within the pathways less than the diameter of the wheel.

8. The apparatus of claim 6 in which the lower ends of the supports on each side of the chair include a wheel and in which the opening in each pathway is sufficiently wide to receive the wheel and extends a length within the pathways greater than the diameter of each wheel and the pathway further includes a back plate forming with the opening a recess that receives the wheel.

9. The apparatus of claim 1 in which the chair includes one wheel at each side thereof.

10. The apparatus of claim 1 in which the chair includes two wheels at each side thereof.

11. The apparatus of claim 9 or claim 10 in which the wheels of the chair are adjustable in their separation distance to accommodate the separation distance of the side pathways.

12. The apparatus of claim 1 in which the stop is a pivoted retractable brake disposed along the length of the pathways.

13. The apparatus of claim 12 in which the brake is pivoted at a lower end.

14. The apparatus of claim 12 in which the brake is pivoted at the upper end.

15. The apparatus of claim 12 in which the brake is pivoted at an intermediate section of the pathways and spaced from the ends.

16. The apparatus of claim 12 or claim 13 or claim 14 or claim 15 in which the brake includes a spring in operative combination with the pivot to maintain the brake in a position such that the brake stops the movement of the chair on the pathways.

17. The apparatus of claim 12 or claim 13 or claim 14 or claim 15 in which the brake is in operative relationship with a means to retract the brake from its stop position.

18. The apparatus of claim 1 in which a rest stop is provided at an interval along the length of each pathway corresponding to approximately the length of each pathway that spans two to three steps.

19. The apparatus of claim 1 in which a rest stop is provided at the midpoint along the length of each pathway.

20. The apparatus of claim 1 in which each pathway is disposed at an angle greater than approximately 45° with respect to a horizontal line at the lower level.

21. An access device for providing assistance in the transit between an upper level and a lower level of a person seated in a chair transport device, including:

a chair transport device in which a person may be seated having a support on each side;

a pair of separate spaced-apart longitudinally extended pathways having upper and lower ends disposed to allow passage between the upper level and the lower level, each pathway having a width sufficient to accommodate a support on one side of a chair, and in which the separation of the pathways is sufficient to provide an access path for at least one assistant who guides the chair with respect to the pathways, in which each pathway includes at least one rest stop for maintaining the location of the chair at a location along each length of the pathway, the rest stop being one of an opening in, recess within or protrusion from the surface of each pathway that is adapted to maintain the location of the chair at the rest stop, the stop being intermediate and spaced from the upper and lower ends thereof, and in which the chair includes a tilt that allows the chair to pivot with respect to the rest stop such that the support on the side of the chair is enabled to traverse thereover.

* * * * *